US007566251B2

(12) United States Patent
Paterson et al.

(10) Patent No.: US 7,566,251 B2
(45) Date of Patent: Jul. 28, 2009

(54) JET PUMPING DEVICE

(75) Inventors: Paul Mark Paterson, Gore (NZ); Barry John Davies, Tuatapere (NZ)

(73) Assignee: Propeller Jet Limited (NZ)

( * ) Notice: Subject to any disclaimer, the term of this patent is extended or adjusted under 35 U.S.C. 154(b) by 0 days.

(21) Appl. No.: 11/914,756

(22) PCT Filed: May 18, 2006

(86) PCT No.: PCT/NZ2006/000119

§ 371 (c)(1),
(2), (4) Date: Nov. 19, 2007

(87) PCT Pub. No.: WO2006/126893

PCT Pub. Date: Nov. 30, 2006

(65) Prior Publication Data

US 2008/0200082 A1 Aug. 21, 2008

(30) Foreign Application Priority Data

May 21, 2005 (NZ) ..... 539561

(51) Int. Cl.
*B63H 5/10* (2006.01)

(52) U.S. Cl. ..... 440/80; 440/38; 415/62; 415/156

(58) Field of Classification Search ..... 440/38, 440/47, 49, 50, 80, 81; 60/221; 114/150, 114/151; 415/62, 68, 69, 121.2, 156, 206
See application file for complete search history.

(56) References Cited

U.S. PATENT DOCUMENTS 5,634,831 A * 6/1997 Davies et al. ..... 440/47
5,679,035 A * 10/1997 Jordan ..... 440/47
6,422,904 B1 * 7/2002 Davies et al. ..... 440/38

FOREIGN PATENT DOCUMENTS

EP 240674 A2 * 10/1987

* cited by examiner

*Primary Examiner*—Lars A Olson
(74) *Attorney, Agent, or Firm*—Galbreath Law Offices, P.C.; John A. Galbreath

(57) ABSTRACT

A propulsion or pumping device which includes two counter-rotating shafts (3, 4) each carrying at least one impeller (7, 8), wherein each impeller (7, 8) can deflect by a predetermined amount in directions substantially perpendicular t to the longitudinal axis of the shaft (3, 4) on which the impeller (7, 8) is mounted.

10 Claims, 3 Drawing Sheets

JET PUMPING DEVICE

FIELD OF THE INVENTION

The present invention relates to devices which incorporate a propeller or impeller moving through a liquid, with the object either of moving a boat in which the impeller or propeller is mounted, or accelerating the liquid. The present invention has been developed particularly for use in jet boats, and will be described with special reference to this application; however, it will be appreciated that the invention also is applicable to any propeller- or impeller-driven watercraft, to pumps, and to hydroelectric generation equipment. As used hereinafter, the term "impeller" includes the term "propeller".

BACKGROUND OF THE INVENTION

A body accelerating through a liquid is subject to a very high friction or drag, compared to the same body accelerating through air. Example, water creates roughly 1000 times more drag than air. Contact between the surface of an object moving relative to a surrounding liquid and the liquid creates drag, to a degree depending upon the viscosity of the liquid, because a layer of liquid tends to adhere to the surface of the object and be carried with it. As the speed of the object increases, the slower moving liquid adhering to it causes a boundary zone of turbulent flow. As a result of this, the energy required to move an object through a liquid increases with velocity. In the case of an object moving through water, the energy required to move the object through the water increases cubically with velocity.

The present invention is particularly concerned with devices moving relative to water, and further discussion is with specific reference to water. However, the present invention would also be useful applied to devices moving relative to other liquids.

Water borne craft, in particular, tend to be subject to very high frictional losses because for the craft, to travel at a reasonable speed, requires the impellers to displace water at relatively high rotational velocities. The frictional losses increase the energy input required to achieve a given speed. A further cause of problems is the cavitation effect:—cavitation is the generation of cavities (for example bubbles) in liquids by rapid pressure changes. When an impeller rotates at high speed in water, there is a significant drop in pressure in the water immediately adjacent the impeller and small bubbles form on the surface of the impeller. When these bubbles implode, they produce shock waves in the water which can cause serious erosion damage to the impeller's surface.

OBJECT OF THE INVENTION

An object of the present invention is the provision of a propulsion or pumping device which reduces the above described frictional losses and cavitation effects.

The present invention provides a propulsion or pumping device which includes two counter rotating shafts each carrying at least one impeller, wherein each impeller can deflect by a predetermined amount in directions substantially perpendicular to the longitudinal axis of the shaft on which that impeller is mounted.

The device of the present invention is particularly well-suited for use in combination with the low pressure jet system disclosed in NZ patent No. 526666, since the system is able to operate with relatively large clearances between the housing and the outer edges of the impellers:—it will be appreciated that if the impellers are to deflect, they require a larger than normal clearance.

The required deflection of each impeller can be achieved in a number of different ways:—

1. Uneven weighting of the impeller blades or impeller boss.
2. Uneven weighting of the impeller shaft.
3. Designing the impellers with more blades on one side of the boss than on the other.
4. Manufacturing one or more blades of the impeller of magnetic material or embedding magnetic material in one or more blades, and using one or more magnetic fields adjacent the impeller can deflect the impeller to cause the impellers to momentarily move during a rotation, due to magnetic attraction/repulsion.
5. Using an out-of-line gearbox to deflect the shaft and hence the corresponding impeller.
6. Deflecting the shaft and the corresponding impeller by introducing water from below the shaft.

Each impeller may be arranged to deflect in one, two, or more directions. In a preferred embodiment of the invention, each impeller deflects in a first direction substantially perpendicular to the longitudinal axis of the shaft, and then in a second direction at 180° to said first direction, during each revolution of the impeller. Typically, each deflection is by a distance in the range 0.70-1.0 millimeter.

DETAILED DESCRIPTION OF PREFERRED EMBODIMENT

By way of example only, a preferred embodiment of the present invention is described in detail, with reference to the accompanying drawings, in which.

Figure 1:
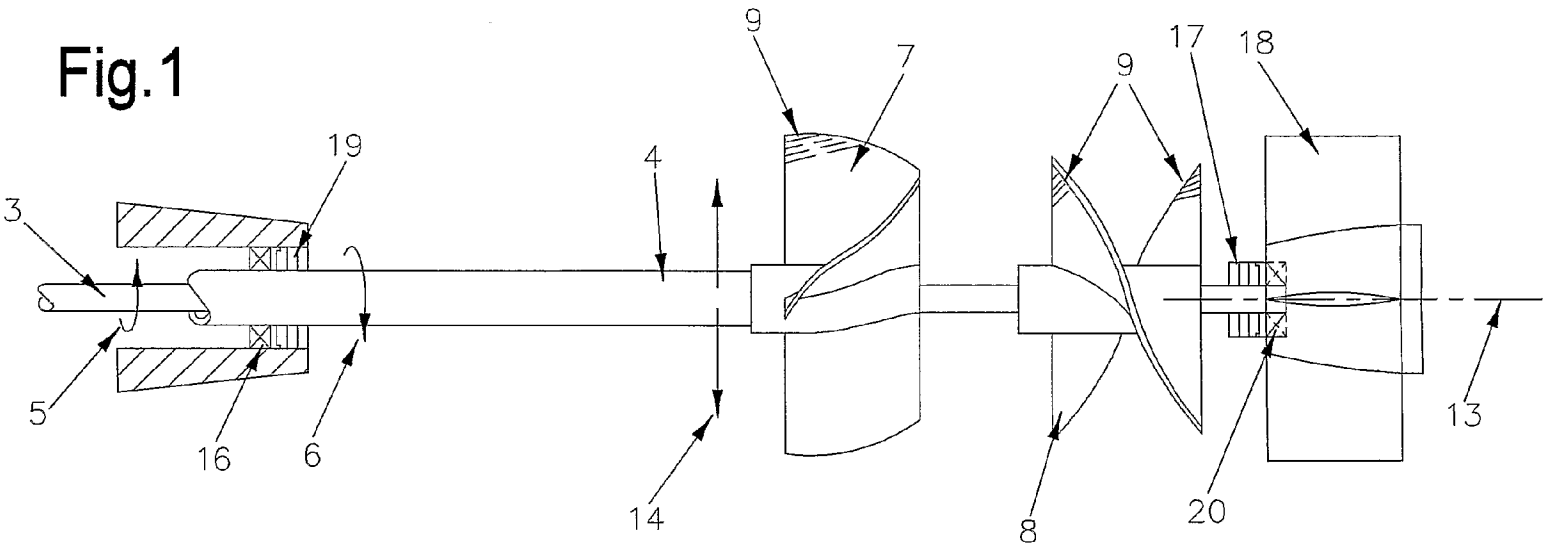
FIG. 1 shows a side view of a jet boat drive in accordance with the present invention.

Referring to the drawings, FIG. 1 shows part of the jet boat drive incorporating the present invention. The drive includes two coaxial shafts:—an outer shaft 4 and an inner shaft 3. The shafts are driven by any suitable means (not shown) to rotate in opposite directions; the direction of rotation of shaft 4 is shown by Arrow 6; the direction of rotation of shaft 3 by Arrow 5.

Figure 2:
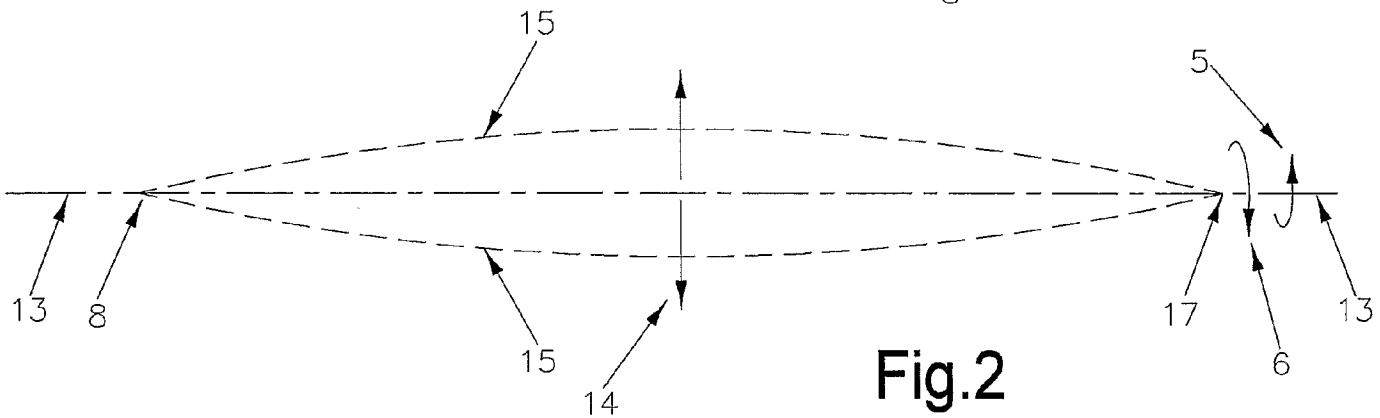
FIG. 2 is a diagram showing the deflection of the impellers of the drive of FIG. 1.

The outer shaft 4 carries an impeller 7 and the inner shaft 3 carries an impeller 8. Both of the impellers 7,8, have the blade or blades on one side of the impeller only, weighted as indicated by broken lines 9. The effect of the weighting is that, as the impellers rotate with their respective shafts, the impellers deflect from their normal path of rotation in directions substantially perpendicular to the longitudinal axes 13 of the shafts, as depicted by FIG. 2. As shown in FIG. 2 (which is exaggerated for clarity), the deflection of the impellers 7,8 also tend to make the shafts 3,4 deflect about their axes 13 in directions perpendicular to the axes 13, as indicated by arrows 14. The deflection of the shafts 3,4 is indicated by broken lines 15.

It is preferred that the impellers are coarse-pitched impellers, typically with a pitch in the range 30° to 50° at the tip to reduce the likelihood of cavitation damage.

The deflection of the shafts 3,4 is most marked on the portion of the shafts between the support bearings 16,20; these bearings may be any of a range of known types but preferably are types of bearing which will accommodate the deflection of the drive shafts without undue wear e.g. selfaligning bearings. (Note: In FIG. 1 the bearing and seal that separate the two shafts 3 and 4 are omitted for clarity.)

As shown in FIG. 1, the impellers 7,8, are not located centrally between the bearings 16,20:—there is a greater length of shaft between the impeller 7 and the corresponding bearing 16 than between the impeller 8 and the corresponding bearing 20. Obviously, the shaft deflection is greatest midway between the bearings 16,20. Thus, the impeller 7 will deflect by a greater distance, for a given imbalance, than the impeller 8. Typically, the deflection of the impeller 8 may be about half that of the impeller 7.

The distance which an impeller deflects depends upon the diameter and speed of rotation of the impeller, as well as upon the amount of imbalance. In a jet drive as shown in FIG. 1, a typical deflection of impeller 7 at an impeller rotation of 3100 rpm would be of the order of 1 millimeter in each direction. However, a stationary pump with an impeller rotation of 2000 rpm might have a deflection of about 0.7 millimeter in each direction.

The drive shown in FIG. 1 is mounted in a housing in known manner and the drive shafts 3,4, are connected via seals to a gearbox and a motor, also in known manner. The end of the drive consists of rear housing 18 which incorporates location vanes and an anti-ventilation device, in known manner. The seals 19,17 adjacent the ends of the shafts should be seals which will accommodate the shaft deflection. (For example spring loaded mechanical seals).

Preferably, the shafts 3,4 are rotated at the same speed, but this is not essential. Preferably, the shafts 3,4 are made from a relatively stiff material such as high tensile steel. The stiffer the shaft, the more the shaft tends to snap back from the deflection:—a softer material (e.g. stainless steel) for the shaft tends to give a slightly damped or "softer" deflection. The shaft material must also be of a type that does not work harder and consequently fatigue.

It will be appreciated that a larger than usual clearance between the impeller and the housing is required to permit the deflection. Jet-drives usually are built with very small tolerances between the impellers and the housing wall:—typically about 0.1 to a maximum of 0.5 millimeter on about 200 millimeter diameter impeller. In this respect, a system of the general type described in New Zealand patent No. 526666, which can provide larger tolerances, is suitable for adaptation in accordance with the present invention, since the design described in New Zealand patent No. 526666 typically accommodates about 1-3 millimeter clearance between the impeller and the housing for about a 200 millimeter diameter impeller set. These tolerances may increase as the pump diameter increases. The impeller to housing wall clearances may vary depending on the design parameters required, i.e. the greater water velocity through a high speed jet propulsion pump will require a different amount of deflection than a stationary pump.

In the design of the jet boat drive, it is an important consideration that air is not allowed to enter through the outlet of the pump:—this can cause ventilation and will in turn cause the pump to de-prime and lose thrust. Thus, it is necessary to match the outlet cross-section to the change in velocity of the water generated by the impeller blades:—if the outlet is too small, this will create excessive back pressure and reduce efficiency. The optimum outlet size is that which allows the pump to remain primed whilst maintaining a minimum back pressure. It has been found that when the impellers deflect, the pump outlet must reduce in cross-sectional area to about 33% of the overall impeller cross-sectional area to avoid ventilation. This is because the change in velocity increases by a factor of about three, indicating that the water is accelerating to a much greater final velocity at the impeller interface.

Figure 3:
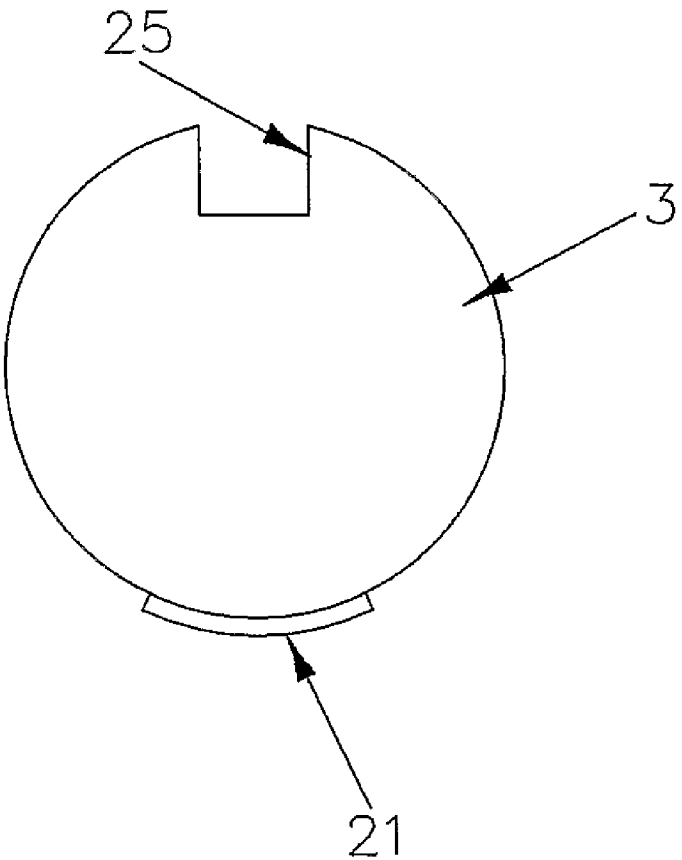
FIG. 3 is an end view of a shaft in accordance with the present invention.

The required deflection of the impellers can be achieved in a number of different ways:—as described above, some of the impeller blades can be weighted. Another possibility is to weight the impeller boss or the shafts unevenly, either by adding weight to one side of the boss/shafts and/or by removing material from the boss/shafts. FIG. 3 shows a cross-section through one of the shafts 3 which is formed with a key way cutout 25 and/or with a weighted area 21.

A further possibility is to manufacture one or more of the blades of each impeller of a magnetic material or to incorporate magnetic material in one or more blades, and operate the impeller in a magnetic field so as to pull the impeller to one side of the shaft as it enters the field.

Figure 4:
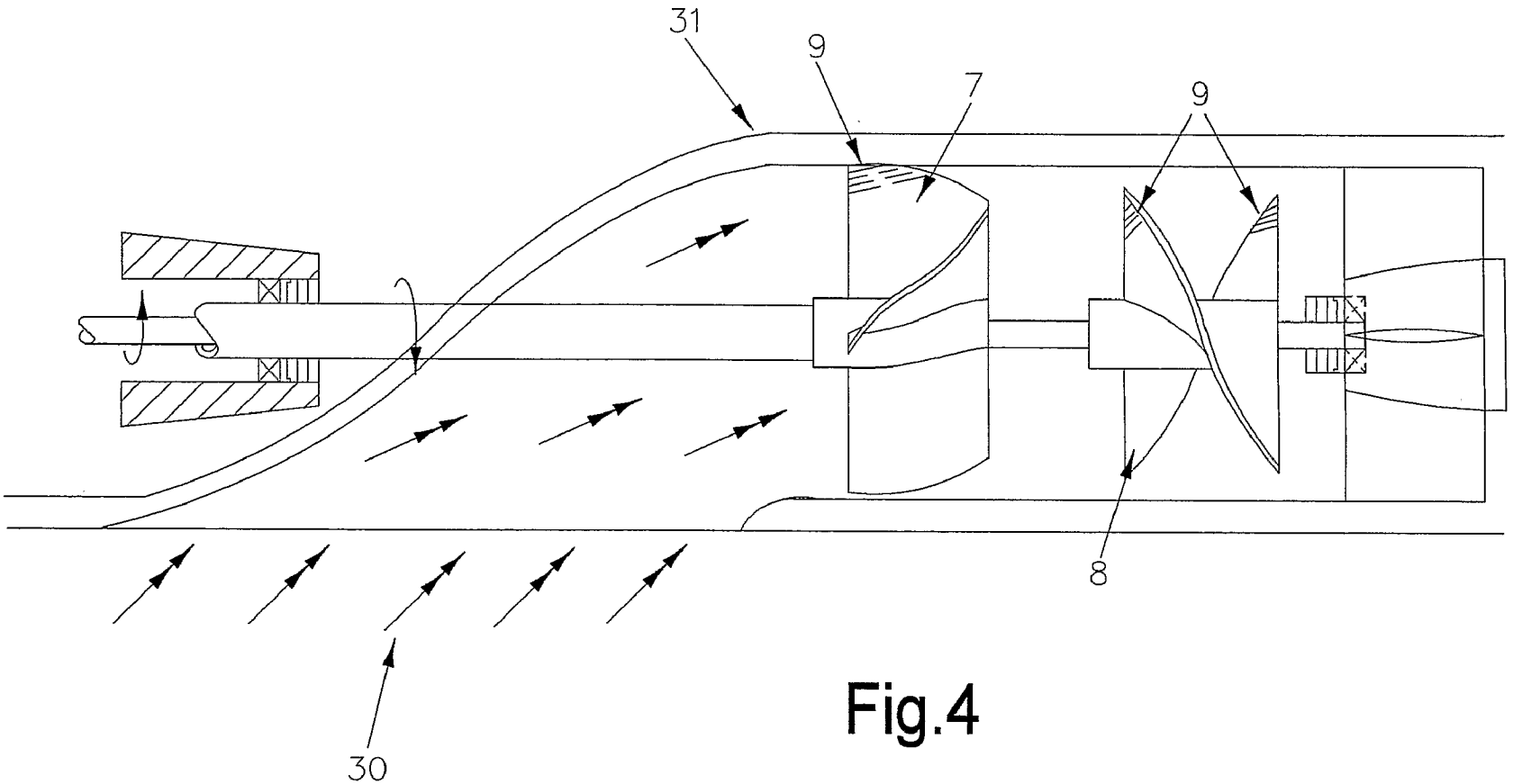
FIG. 4 is a diagrammatic view of a further embodiment of the present invention.

Another method of achieving the desired deflection is as shown in FIG. 4. In FIG. 4, the general arrangements of shafts, impellers and bearings is as shown in FIG. 1, and the same reference numerals are used. The water intake 30 into the housing 31 is through an opening below the line of the impellers. Thus, water entering the housing, (as shown by double-headed arrows) exerts an upwards deflection force on the shafts and impellers, which then deflect back to their neutral position.

A drive of the above described type has been found to have a significant improvement in efficiency:—typically an improvement of between 40% and 50% could be achieved with either a stationary pump or a jet drive unit by incorporating the present invention.

Experiment 1. A twin counter-rotating shaft impeller jet pump, designed for high mass/low pressure operation, with each shaft carrying an impeller of the same diameter and pitch was installed in a four meter boat. In normal operation, with both of the shafts rotated at the same speed, the top speed of the boat was about 25 kilometers per hour, with a horsepower input to achieve this of about 450 horsepower.

The impeller tips on both impellers were machined to reduce their diameter and to create a deflection, and the top speed of the boat when retested was approximately 90 kilometers an hour.

Experiment 2. A jet drive was designed in accordance with the present invention and then progressively modified to reduce the degree of deflection of the impellers; the variation in efficiency was measured.

The drive was fitted to a five meter boat with a two liter capacity engine. With the impellers oscillating in accordance with the present invention, the top speed of the boat was approximately 90 kilometers per hour. In addition, the acceleration of the boat was exceptional:—0-90 kilometers per hour in six seconds.

The deflection effect was then reduced through better balancing of the shafts and impellers, whereupon the boat speed dropped to a top speed of 80 kilometers per hour, and the fuel consumption increased.

Further reduction in the deflection reduced to the top boat speed to about 75 kilometers per hour, and when the deflection was entirely removed, by providing a totally rigid shaft construction, the boat top speed dropped to about 55 kilometers per hour.

Experiment 3. A stationary pump was designed using counter-rotating shafts each carrying an impeller, designed to permit deflection; efficiencies of between 83%-93% were achieved.

The invention claimed is:

1. A propulsion or pumping device which includes two counter-rotating shafts each carrying at least one impeller, wherein each impeller is arranged to deflect in a first direction substantially perpendicular to a longitudinal axis of the shaft on which that impeller is mounted and by a substantially equal distance in a second direction at 180° to said first direction, during each revolution of the impeller.

2. The device as claimed in claim 1 wherein the deflection of each impeller is achieved by uneven weighting of impeller blades.

3. The device as claimed in claim 1 wherein the deflection of each impeller is achieved by uneven weighting of an impeller boss.

4. The device as claimed in claim 1, wherein the deflection of each impeller is achieved by uneven weighting of the corresponding shaft.

5. The device as claimed in claim 1 wherein the deflection of each impeller is achieved by manufacturing one or more blades of the impeller of a magnetic material.

6. The device as claimed in claim 1 wherein the deflection of each impeller is achieved by incorporating magnetic material in one or more blades of the impeller, and providing at least one magnetic field adjacent the impeller.

7. The device as claimed in claim 1, wherein the deflection of each impeller is achieved by driving each shaft via an out-of-line gearbox.

8. The device as claimed in claim 1, wherein the diameter of each impeller is approximately 200 millimeter and the distance of each deflection is in the range 0.7-1.0 millimeter.

9. The device as claimed in claim 1 wherein each shaft carries a single impeller and the impeller which is upstream relative to the direction of flow of water through the device in use is arranged to deflect by a greater distance than the downstream impeller.

10. The device as claimed in claim 1 wherein each shaft carries a single impeller and the impeller which is upstream relative to the direction of flow of water through the device in use is arranged to deflect by a greater distance than the downstream impeller, such that the deflection of the downstream impeller is about half that of the upstream impeller.

* * * * *